United States Patent [19]

Morrison et al.

[11] 4,274,223

[45] Jun. 23, 1981

[54] WATER TOY

[75] Inventors: Howard J. Morrison, Deerfield; Harry Disko, South Barrington, both of Ill.

[73] Assignee: Marvin Glass & Associates, Chicago, Ill.

[21] Appl. No.: 119,821

[22] Filed: Feb. 8, 1980

[51] Int. Cl.[3] ..... A63H 23/06

[52] U.S. Cl. ..... 46/95; 46/93

[58] Field of Search ..... 46/91, 92, 93, 94, 95

[56] References Cited

U.S. PATENT DOCUMENTS

| | | | |
|---|---|---|---|
| 1,483,672 | 2/1924 | Moss | 46/91 |
| 1,903,805 | 4/1933 | Buckley | 46/92 |
| 2,661,571 | 12/1953 | Ramsay | 46/95 |
| 3,303,602 | 2/1967 | Douglas | 46/93 X |
| 3,571,966 | 3/1971 | Phelps | 46/94 |
| 3,638,353 | 2/1972 | Frye et al. | 46/94 X |

*Primary Examiner*—F. Barry Shay

*Attorney, Agent, or Firm*—Mason, Kolehmainen, Rathburn & Wyss

[57] ABSTRACT

A water toy or tube toy propelled by a jet of water includes an elongated body having an internal cylinder for containing a variable volume of water therein. A piston is mounted for slidable movement in the cylinder and is biased in one direction to decrease the volume of water in the cylinder by discharging a propelling jet stream of water from the rear end of the body. Valve means is provided permitting the filling of the cylinder with water when the piston is moved in an opposite direction and floatation means is provided for supporting the body on the water.

21 Claims, 4 Drawing Figures

WATER TOY

BACKGROUND OF THE INVENTION

1. Field of the Invention

The present invention relates to water toys and more particularly to a tub toy of the type propelled by a jet of water discharged from the rear of the toy.

2. Brief Description of the Prior Art

A wide variety of tub toys have been developed over the years and some of these toys have offered propelling means of a jet action type.

OBJECTS OF THE INVENTION

It is an object of the present invention to provide a new and improved water toy and more particularly a tub toy of the type propelled by a jet stream of water expelled from the rear end of the toy.

Another object of the present invention is to provide a new and improved toy of the character described which includes an elongated body having an internal cylinder and a piston slidably disposed in the cylinder and biased in one direction to decrease the volume of water by discharge of a propelling jet stream from the rear end of the toy's body.

Another object of the present invention is to provide a new and improved toy of the character described wherein a unique valving system is provided for permitting the internal cylinder of the toy to be filled with water when the piston is manually withdrawn so that subsequently a biasing force will act on the piston to form a jet stream of water for propelling the toy.

Yet another object of the present invention is to provide a new and improved water toy of the character described which is fun to play with, simple in operation, pleasing in appearance and suitable for production on a mass production basis at an economical cost.

SUMMARY OF THE INVENTION

The foregoing and other objects and advantages of the present invention are accomplished in an illustrated embodiment comprising a new and improved water toy propelled by a jet of water and including an elongated body having an internal cylinder therein for containing a variable volume of water. A piston is slidably mounted in the cylinder and is biased in one direction to decrease the volume of water in the cylinder by discharging a propelling jet stream of water from the rear end of the body. A valve system is utilized to permit the filling of the cylinder with water when the piston is manually retracted in an opposite direction against the force of the biasing means. A floatation system may be provided externally of the body for supporting the toy in the water for movement under the influence of the water jet discharging therefrom. The water toy is of the type suitable for play with in the bathtub or a small pond and is especially well adapted for play and use by young children and the like. The toy may be provided with a design or dress that simulates a scuba diver, an animal such as a turtle or alligator, a high speed racing boat or an underwater submarine type vehicle.

BRIEF DESCRIPTION OF THE DRAWINGS

For a better understanding of the present invention, reference should be had to the following detailed description in conjunction with the drawings, in which.

DESCRIPTION OF THE PREFERRED EMBODIMENT

Figure 1:
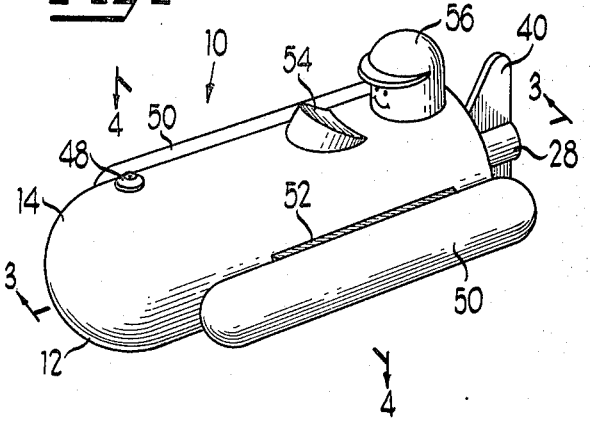
FIG. 1 is a front perspective view of a new and improved water toy constructed in accordance with the features of the present invention showing the boat design.
Figure 2:
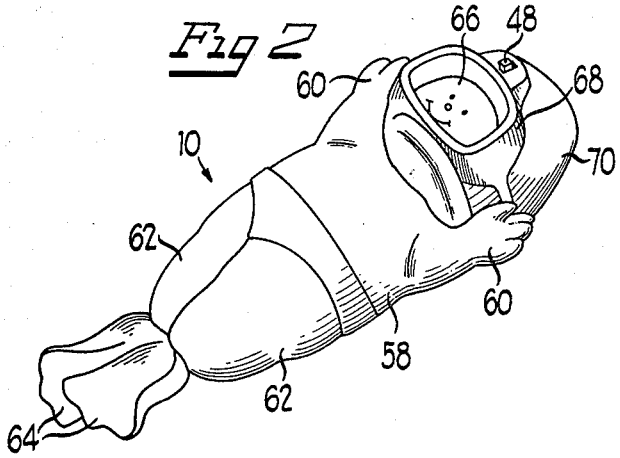
FIG. 2 is a front perspective view of another embodiment showing the scuba diver design of the present invention.

Referring now more particularly to the drawings, there is illustrated a new and improved water toy adapted to be propelled by a jet stream of water and constructed in accordance with the features of the present invention. The boat design is shown in FIG. 1 and the scuba diver design is shown in FIG. 2, both being generally referred to by the reference numeral 10. The boat design of FIG. 1 includes an elongated hollow body or central hull portion 12 of circular transverse cross section and preferably formed of lightweight molded plastic material. The elongated hull or body 12 includes an integral spherically shaped forward end wall 18. The rear end wall has a central aperture defined therein by an inwardly extending, cylindrical sleeve or flange 20 coaxially aligned with the longitudinal axis of the ball.

A cup-shaped piston assembly 22 is mounted for longitudinal sliding movement between opposite rearward and forward ends of the hull cylinder 16 and the piston includes a radial wall portion 24 having a cylindrical forwarding extending skirt portion 26 of flexible material around the periphery thereof and adapted to slidably engage the inside wall surface of the cylinder 16. The piston assembly includes a rearwardly extending, hollow tubular stem 28 in coaxial alignment with the rear end wall sleeve 20 and open at forward and rearward ends as shown in order to accommodate an elongated, rubberband 30 having a forward end secured to an internal hook 32 provided at the center of the dome-shaped front end wall 14. A rear end of the rubberband is engaged around a hooked inner end portion 34 of a rivet-like, plug element 36 having a rounded outer end or cap seated against the outer end surface of the tubular sleeve 28.

Figure 3:
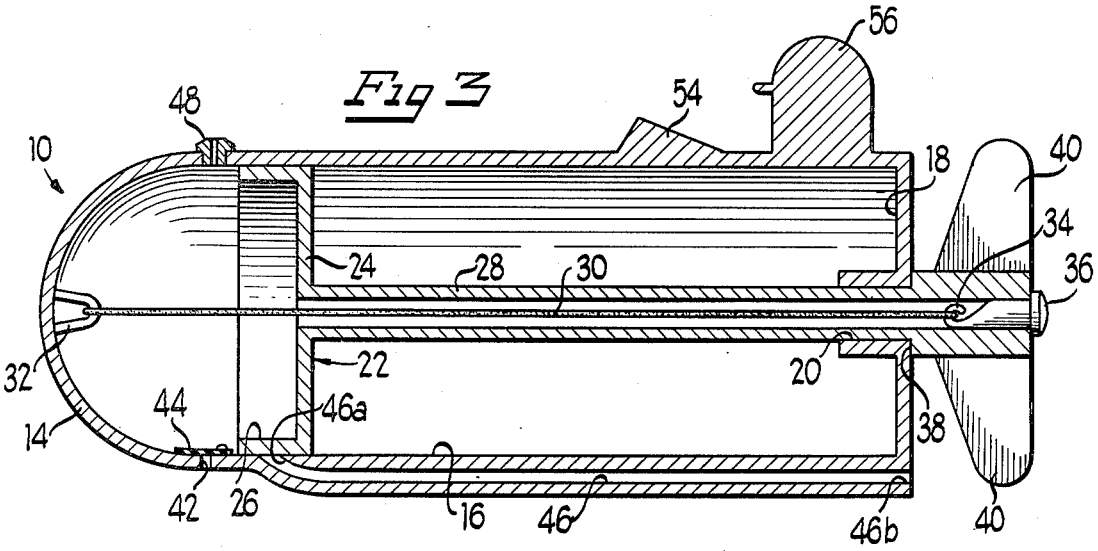
FIG. 3 is a vertical longitudinally extending cross-sectional view taken substantially along lines 3—3 of FIG. 1.
Figure 4:
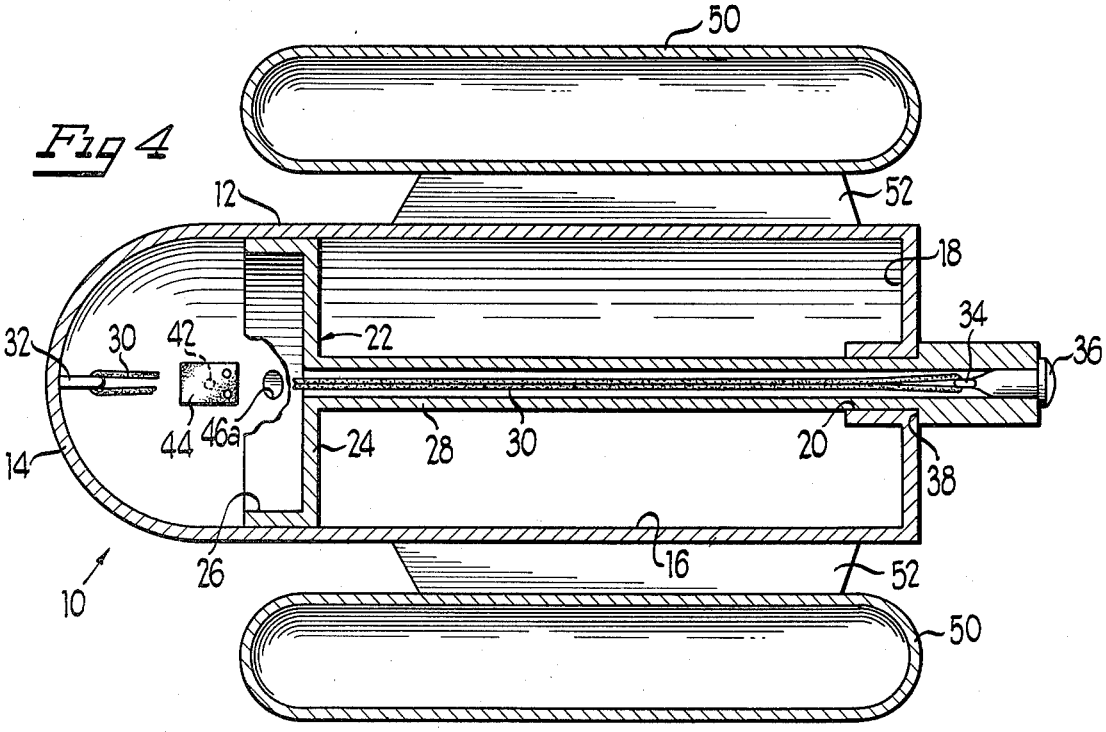
FIG. 4 is a horizontal longitudinal cross-sectional view taken substantially along lines 4—4 of FIG. 1.

An outer end portion of the stem 28 is formed with an enlarged section of outer diameter so that a radial shoulder 38 may provide stopping engagement when in contact with the outer surface of the rear wall 18 to limit the forward travel of the piston assembly 22 as shown in FIGS. 3 and 4. In this full forward position as shown, substantial tension is present in the rubberband 30 and accordingly the piston assembly is always biased forwardly in the cylinder 16 by the rubberband toward a forward position wherein the annular stop surface 38 is abutting against the outer surface of the rear end wall of the cylinder.

In accordance with a feature of the present invention, the enlarged diameter, rear end section of the hollow stem 28 is provided with an integrally formed vertically extending handle 40 which extends upwardly and downwardly of the stem axis. The lower portion of the handle provides a rubber for guidance and steerage of the boat in a straight path when the boat is propelled in the water. When the handle 40 is manually retracted rearwardly of the end wall 18 in one hand while holding the body 12 of the boat in the other hand, the volume of water contained in the cylinder 16 forwardly of the piston assembly 22 is increased and tension on the rubberband is similarly increased to a maximum value when the radial wall of the cylinder 24 reaches a rearward stop position against the inner end of the sleeve 20 on the rear end wall 18.

In order to permit water to flow into the forward end of the cylinder as the handle 40 is retracted rearwardly, an inlet port 42 is provided in a bottom wall portion of the hollow cylinder 16 just forwardly of the piston skirt 26 when the piston assembly 22 is in the full forward position. A flapper valve 44 of flexible material is mounted on the inner surface of the cylinder wall above the inlet port 42 to serve as a check valve and prevent water in the cylinder ahead of the piston assembly 22 from being forced out through the opening 42 as the piston moves forwardly under the bias of the rubberband.

Thus, when the piston assembly 22 is retracted rearwardly by manual pull on the handle-like fins 40, water is sucked into the forward end of the cylinder ahead of the piston wall 24 through the inlet port 42 and flapper valve 44. Subsequently, when the handle is released, the rubberband 30 urges the piston assembly on a forward stroke in the cylinder. During a forward stroke, water is prevented from flowing out through the inlet port 42 as the flapper valve 44 is pressured into a closed position. Water may also enter the forward end of the cylinder during a rearward stroke of the piston assembly by moving past the flexible piston skirt 26 from the rear end of the cylinder.

In accordance with the present invention, the body 12 of the boat is provided with an elongated water passage or tubular conduit 46 may be integrally formed on the lowermost surface of the cylinder wall as shown. The passage has an upwardly curving forward end in communication with the forward end of the cylinder 16 through an outlet or discharge port 46*a*. At the rearward end of the body, the conduit 46 is open and forms an outlet nozzle 46*b* for directing a jet stream of water rearwardly of the boat to propel the boat in a forward direction by virtue of the reactive force from the jet of water.

The forward bias on the piston assembly 22 obtained by the rubberband 30 tends to continually reduce the volume of water contained in the forward end of the cylinder ahead of the piston wall 24 and this force is effective to eject water rearwardly through the conduit 46 and out the nozzle end 46*b*. The jet action continues as the piston assembly 22 moves on a forward stroke until reaching a full forward position as shown in FIGS. 3 and 4.

In addition to the rearwardly directed jet stream of water from the nozzle outlet 46*b*, a small nozzle 48 is mounted in an opening on the upper surface of the cylinder wall 16 at a forward position ahead of the piston skirt 26. As the piston assembly is moving forward to propel the vehicle in a forward direction, a small amount of water is ejected upwardly in spurts through a small diameter passage in the nozzle 48 and this provides a shower-like effect not unlike that produced by a whale when ejecting water from an upper blowhole.

In order to support the boat for floating movement adjacent the surface of the water, the boat hull 12 if provided with a pair of elongated, generally cylindrical, rounded end, water-tight floatation chambers 50 disposed in spaced apart, parallel relation on opposite sides of the centerline of the cylinder 16. Each floatation chamber is generally circular in transverse cross section and is joined at mid-level to the main body 12 through a horizontal spacer fin or web 52 as shown in FIGS. 1 and 4. The forward end of the floatation chambers 50 are positioned rearwardly of the rounded forward end 14 of the main body 12 and this arrangement helps to guide the boat on a straight line course during movement.

In accordance with another feature of the present invention, an upper surface portion of the hull body 12 is formed with a windshield-like projection 54 and rearwardly thereof is provided a character to resemble the racedriver of a fast moving water vehicle. The volume of the floatation chambers 50 is sufficient to support the entire boat adjacent the upper surface of the water even when the larger, main body cylinder 16 is completely filled with water such as when the piston assembly 22 is fully retracted rearwardly prior to a launch. Subsequently, as the volume of water forwardly of the piston assembly 22 is expelled to propel the craft forwardly, the weight of the displaced water leaving the vehicle through the jet nozzles 46*b* and 48 may provide for a more buoyant floatation of the craft.

The scuba diver design as shown in FIG. 2 is similar in many respects to the previously described boat design. In particular, the scuba diver design includes a body portion 58 in the form and shape of a human figure characterized by a pair of forwardly extending arms and hands 60, a pair of legs 62, a pair of flippers 64 at the ends of the legs and a head portion 66. The head portion includes a face having eyes, nose and a mouth which is enclosed within a diving mask 68 while the entire head is covered by a helmet 70.

In this embodiment, a cylinder 16 is mounted within the body 58 with the piston 24 mounted within the cylinder. The biasing means, such as the rubberband 30, is similarly mounted as previously described and connected to the feet or flippers 64 which serve as the handle 40 to retract the piston against the force of the biasing means 30. All of the other structural elements are within the spirit and scope of those previously described with respect to the embodiment shown in FIG. 1 including the one-way water inlet valve 42 and the spurting, water exit valve 48 shown on the top of the diver's mask 68. In addition to the description with respect to the embodiment shown in FIG. 2, it is also contemplated that the outer housing 58 of the "figurine" type design may be made in the form and shape of various other animals or creatures such as an alligator, turtle, crocodile, fish, or any other marine creature. In the various designs contemplated by the illustration in FIG. 2, the cylindrical portion 16 will be smaller than the external housing 58 and an air space between the cylinder and the external housing will provide the necessary floatation means 50 described previously with respect to the boat embodiment. Also, in order not to disrupt the outlines of the animal or human figure, the discharge tube 46 may be mounted internally, by means of a flexible tube or the like, connecting the front end of the cylinder, where the pressurized water is generated, to apertures at the rearmost or bottom portion of the figure, such as in the legs adjacent the flippers 64 to propel the toy forwardly.

Although the present invention has been described with reference to two illustrated embodiments thereof, it should be understood that numerous other modifications and embodiments such as those previously described can be devised by those skilled in the art that will fall within the spirit and scope of the principles of this invention.

We claim:

1. A water toy propelled by a jet of water, comprising:

an elongated body portion having an externally opening outlet nozzle;

an internal cylinder in said body, communicating with said nozzle for containing a variable volume of water;

a piston slideably disposed in said cylinder and means in said body for biasing said piston in one direction to decrease the volume of water by discharging a stream of water from said nozzle;

said biasing means including an elongated stretchable bias element secured at one end to said cylinder and at an opposite end to an elongated stem on said piston, said stem including a hollow tube in coaxial alignment with a longitudinal axis of said cylinder and said bias element extending inside said tube; and valve means in said body permitting the filling of said cylinder with water when said piston is moved in an opposite direction.

2. The water toy of claim 1 wherein said elongated stem extends outwardly of said cylinder with handle means on an outer end of said stem for retracting said piston in said opposite direction against the force of said bias means to increase the volume of water drawn into said cylinder.

3. The water toy of claim 1 including fastening means for securing an outer end of said bias element to an outer end portion of said stem.

4. The water toy of claim 5 including fastening means for securing an inner end of said bias element to an end wall of said cylinder.

5. The water toy of claim 1 wherein said piston includes a skirt of flexible material for permitting water to enter said cylinder around the periphery thereof when said piston is moved in said opposite direction.

6. The water toy of claim 1 wherein said valve means includes a flexible element adjacent an opening in a wall of said cylinder and movable away from said opening to permit an inflow of water into said cylinder when said piston is retracted in said opposite direction.

7. The water toy of claim 1 wherein said cylinder is formed with one or more outlet ports for discharging water to form said propelling jet stream of water as said volume of water in said cylinder is reduced by biased movement of said piston in said one direction.

8. The water toy of claim 7 including a tubular conduit in communication with said outlet port having an outlet end forming said nozzle for discharging said jet stream of water to propel said toy.

9. The water toy of claim 8 wherein said outlet end of said conduit is positioned adjacent one end of said body to form said jet stream aligned in a direction longitudinally of said cylinder.

10. The water toy of claim 9 wherein said conduit is spaced below said cylinder on an underside of said body portion.

11. The water toy of claim 9 wherein said conduit is mounted within said body portion.

12. The water toy of claim 1 including floatation means for said toy.

13. The water toy of claim 12 wherein said floatation means comprises a pair of sealed air chambers on opposite sides of said cylinder.

14. The water toy of claim 13 wherein said air chambers are spaced laterally outwardly of said cylinder and comprise elongated vessels in longitudinal parallel relation with said cylinder on opposite sides of a central longitudinal axis thereof.

15. The water toy of claim 12 wherein said floatation means is within said body portion.

16. The water toy of claim 2 wherein said handle means includes rudder means extending downwardly into the water for guiding said boat.

17. The water toy of claim 1 including nozzle means in communication with said cylinder for directing spurts of water upwardly of said boat when said piston is moving in said one direction.

18. The water toy of claim 11 including decorative means on an upper wall portion of said cylinder designed to resemble a driver of said boat.

19. The water toy of claim 18 wherein said decorative means includes a windshield on said upper wall portion spaced forwardly of said driver.

20. The water toy of claim 13 wherein said cylinder and said air chambers are formed with rounded forward end walls.

21. The water toy of claim 20 wherein said rounded forward end walls of said air chambers are positioned rearwardly of said rounded forward end wall of said cylinder.

* * * * *